US006416088B1

(12) United States Patent
Graute

(10) Patent No.: US 6,416,088 B1
(45) Date of Patent: Jul. 9, 2002

(54) POWER-OPERATED MOTOR-VEHICLE DOOR LATCH WITH ANTITHEFT

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/657,721

(22) Filed: Sep. 8, 2000

(30) Foreign Application Priority Data

Sep. 10, 1999 (DE) ..... 199 43 483

(51) Int. Cl.[7] ..... E05C 3/06; E05C 3/16
(52) U.S. Cl. ..... 292/216; 292/201; 292/DIG. 23
(58) Field of Search ..... 292/216, 201, 292/DIG. 23, DIG. 25; 70/264, 277

(56) References Cited

U.S. PATENT DOCUMENTS 4,978,154 A * 12/1990 Kleefeldt et al. ..... 292/201
5,078,436 A * 1/1992 Kleefeldt et al. ..... 292/201
5,180,198 A * 1/1993 Nakamura et al. ..... 292/201
5,802,894 A * 9/1998 Jahrsetz et al. ..... 70/264
5,833,282 A * 11/1998 Ikeda ..... 292/201
5,997,055 A * 12/1999 Strathmann ..... 292/201
6,145,354 A * 11/2000 Kondo et al. ..... 70/279.1

* cited by examiner

*Primary Examiner*—Lynne H. Browne
*Assistant Examiner*—John B. Walsh
(74) *Attorney, Agent, or Firm*—Herbert Dubno; Andrew Wilford

(57) ABSTRACT

A motor-vehicle door latch has a latch housing, a latch fork pivotal on the housing, a latch pawl movable on the housing between a holding position engaging the fork and preventing pivoting of same and a freeing position permitting pivoting of the latch fork, and a locking lever displaceable coupled with the latch pawl and displaceable between a unlocked position permitting the latch pawl to move into the freeing position and a locked position preventing movement of the latch pawl into the freeing position. A pivotal control member is movable between a power-open position pivoting the latch pawl into the freeing position, an antitheft-on position blocking movement of the locking lever into the unlocked position, and an antitheft-off position permitting movement of the locking lever into the locked position. A drive including a single electrical motor is connected to the control member for pivoting same between its power open, antitheft-on, and antitheft-off positions.

6 Claims, 8 Drawing Sheets

FIG.1a
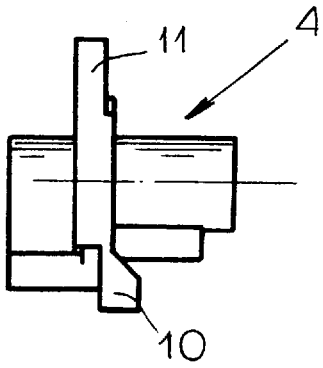
FIG.1b
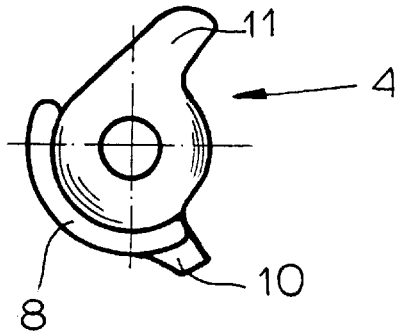
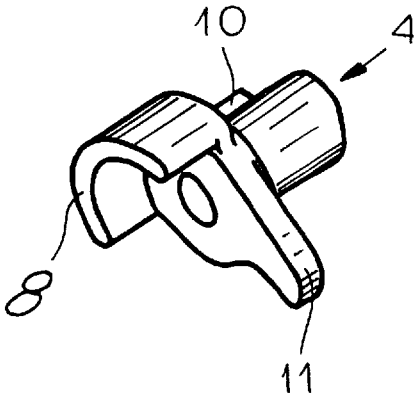
FIG.1c
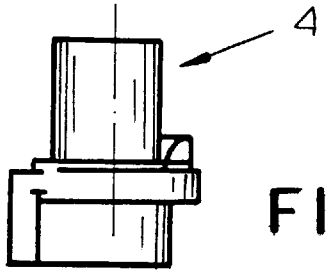
FIG.1d
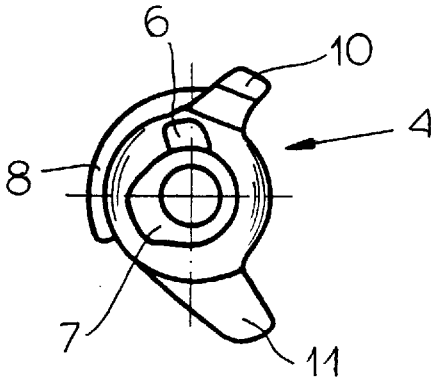
FIG.1e

POWER-OPERATED MOTOR-VEHICLE DOOR LATCH WITH ANTITHEFT

FIELD OF THE INVENTION

The present invention relates to a motor-vehicle door latch. More particularly this invention concerns a power-operated such latch with antitheft features.

BACKGROUND OF THE INVENTION

A standard motor-vehicle door latch has a housing normally mounted on a door edge on which is pivoted a latch fork engageable around a door bolt carried on a door post. A pawl is engageable with the latch fork to hold it in a position engaged around the bolt and, thereby, hold the door carrying the latch closed. Inside and outside handles are normally coupled to a release lever in turn acting on the pawl for opening the latch. A locking lever can block or interrupt the connection between the handles and the release lever to disable one or both of these handles and thereby lock the door. This locking lever is typically operated by a button or lever inside the door and/or a lock cylinder accessible from outside the door.

An antitheft lever in the latch can provide a higher level of security by disconnecting or blocking the release lever so that even a person inside the vehicle cannot unlock the door by means of the standard inside locking button or lever. Only a person with a special key or a particularly coded remote-entry device can use this antitheft feature. Both the antitheft lever and the release lever can further be operated by respective actuators, normally small electric motors, of a central-locking system.

In the newest door latches a small electric actuator, typically a motor, is also provided which serves for power opening of the door. Thus when the door is latched but not locked, actuation of the door handle will trip a switch that in turn operates the opening actuator for effortless unlatching of the door. This is particularly useful in doors having power-latching systems where the door is pulled very tightly closed by the same motor that opens it, so that the person operating the door does not have to exert a large amount of force to tightly close the door or open it. In a so-called keyless entry system when the door is latched and locked, a person carrying a coded transponder operates a door handle to cause the control system to query the transponder and, if the returned code is correct, unlatch and power-open the door.

OBJECTS OF THE INVENTION

It is therefore an object of the present invention to provide an improved motor-vehicle door latch.

Another object is the provision of such an improved motor-vehicle door latch which overcomes the above-given disadvantages, that is which has both antitheft and power-opening features.

SUMMARY OF THE INVENTION

A motor-vehicle door latch has according to the invention a latch housing, a latch fork pivotal on the housing, a latch pawl movable on the housing between a holding position engaging the fork and preventing pivoting of same and a freeing position permitting pivoting of the latch fork, and a locking lever displaceable coupled with the latch pawl and displaceable between a unlocked position permitting the latch pawl to move into the freeing position and a locked position preventing movement of the latch pawl into the freeing position. A pivotal control member is movable between a power-open position pivoting the latch pawl into the freeing position, an antitheft-on position blocking movement of the locking lever into the unlocked position, and an antitheft-off position permitting movement of the locking lever into the locked position. A drive including a single electrical motor is connected to the control member for pivoting same between its power-open, antitheft-on, and antitheft-off positions.

Thus with this system the already provided motor for the antitheft mode is used for power opening of the latch. The control member allows this single actuator to perform both functions. It is a relatively simple job to program the latch control system for such operation.

According to the invention a release lever is connected between the control member and the latch pawl, although it is within the scope of this invention for the control member to act directly on the latch pawl.

Furthermore according to the invention the control member is pivotal and has an arm engageable directly with the locking lever and at least indirectly with the latch pawl. It can, instead, have two arms one engageable directly with the locking lever and the other at least indirectly engageable with the latch pawl.

The latch according to the invention further has an outside actuating lever and an outside locking lever displaceable between a position coupling the outside actuating lever with the latch pawl and a position decoupling the outside actuating lever from the latch pawl. The control member is pivotal and has a bump engageable with the outside locking lever to displace same into its decoupling position. Furthermore the latch has an outside cylinder coupled to the outside locking lever to displace it between its coupling and decoupling positions. The control member has a cam bump engageable with the outside locking lever for displacement of the member into the antitheft off position on actuation of the outside locking lever by the cylinder.

BRIEF DESCRIPTION OF THE DRAWING

The above and other objects, features, and advantages will become more readily apparent from the following description, reference being made to the accompanying drawing in which:

FIGS. 1*a* through 1*e* are various views of the control member in accordance with the invention;

SPECIFIC DESCRIPTION

Figure 1:
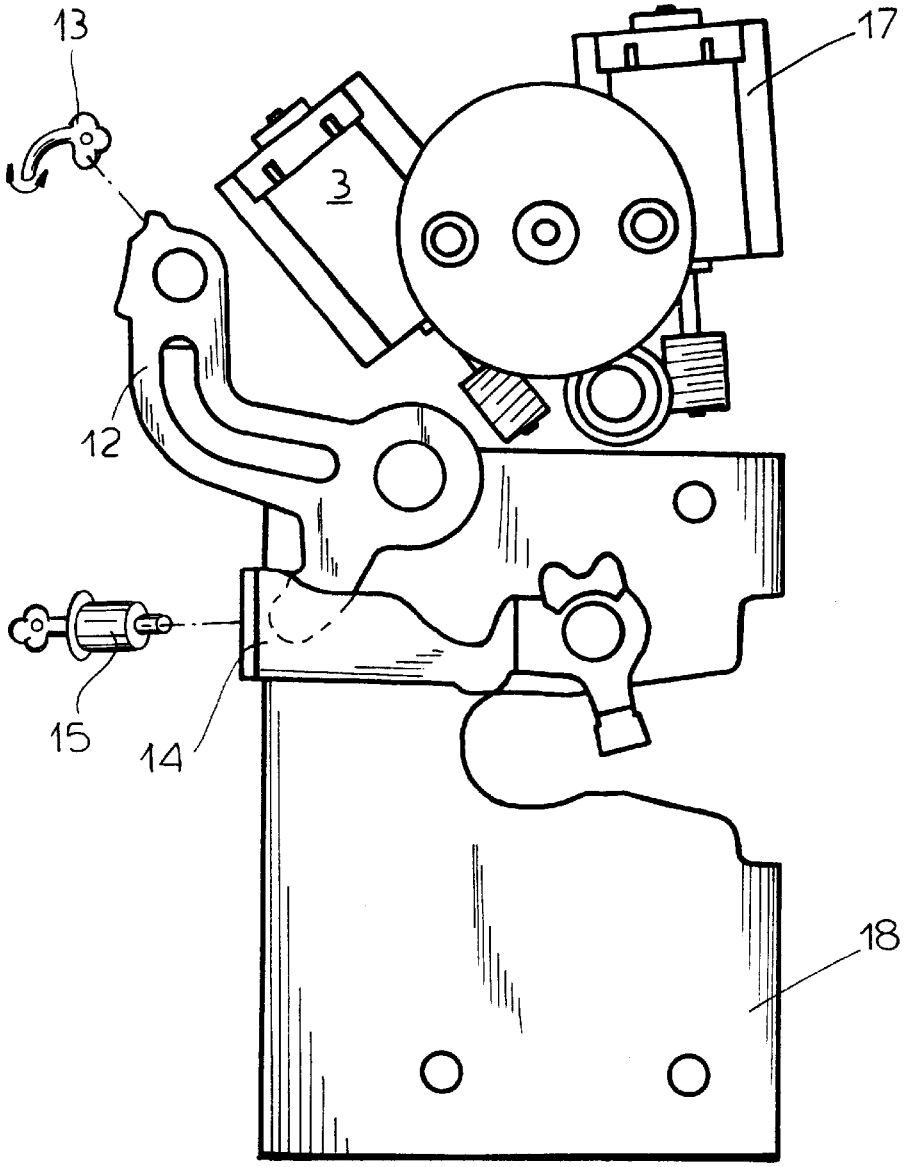
FIG. 1 is a partly diagrammatic side view with some parts removed for clarity of view of the latch according to the invention.

As seen in FIGS. 1 and 2 through 5 a latch according to the invention has a housing 18 on which is carried a standard latch fork 1 engageable by a pawl 2 to hold it in a position retaining an unillustrated doorpost-mounted bolt in the housing 18. The latch has a standard release lever 5 that is pivoted to move the pawl 2 and an outside actuating lever 12 normally operated by an outside door handle 13 that can in turn pivot the release lever 5. An outside locking lever 14 normally operated by a lock cylinder 15 accessible from outside the door can pivot counterclockwise from the illustrated position to decouple the operating lever 12 from the release lever 5 in a locked position.

The latch of FIGS. 1, 2, 3, 4, and 5 has an electric-motor worm drive 17 that can move the release lever 5 between the coupling and decoupling position, and all the illustrated latches have an electric-motor worm drive 3 that serves for setting the latch in an antitheft-on position in which an inside operating element cannot unlock the latch and an antitheft-off position allowing normal operation of the latch from inside and outside. This above-described structure is all generally standard.

According to the invention the antitheft drive 3 also serves for power-opening of the latch. To this end it can act on a control member 4 pivotal about an axis A and shown in detail in FIGS. 1*a* through 1*e*. It has an arm 10 engageable with an abutment 9 of the locking lever 16, and arm 11, and two cam bumps 6 and 7, the latter serving to actuate position-reporting micro-switches. The member 4 could have only one arm, in which case it would have to rotate through 3600° to effect both antitheft and power-open functions. The member 4 has an array of teeth 8 meshing with a worm gear of the drive 3 for pivoting by the drive 3 in either direction about its axis A.

Figure 2:
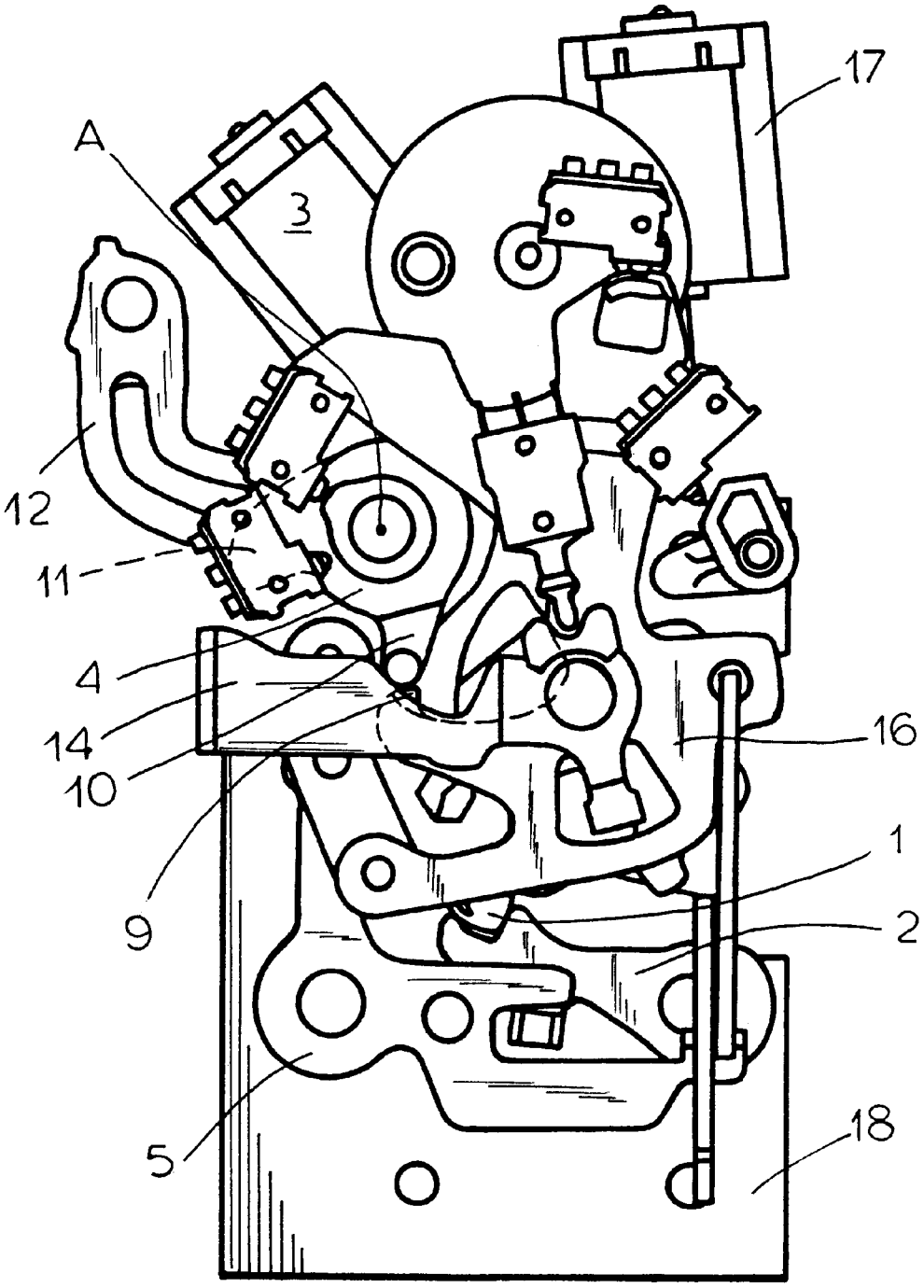
FIG. 2 is a side view of the latch of FIG. 1.
Figure 2A:
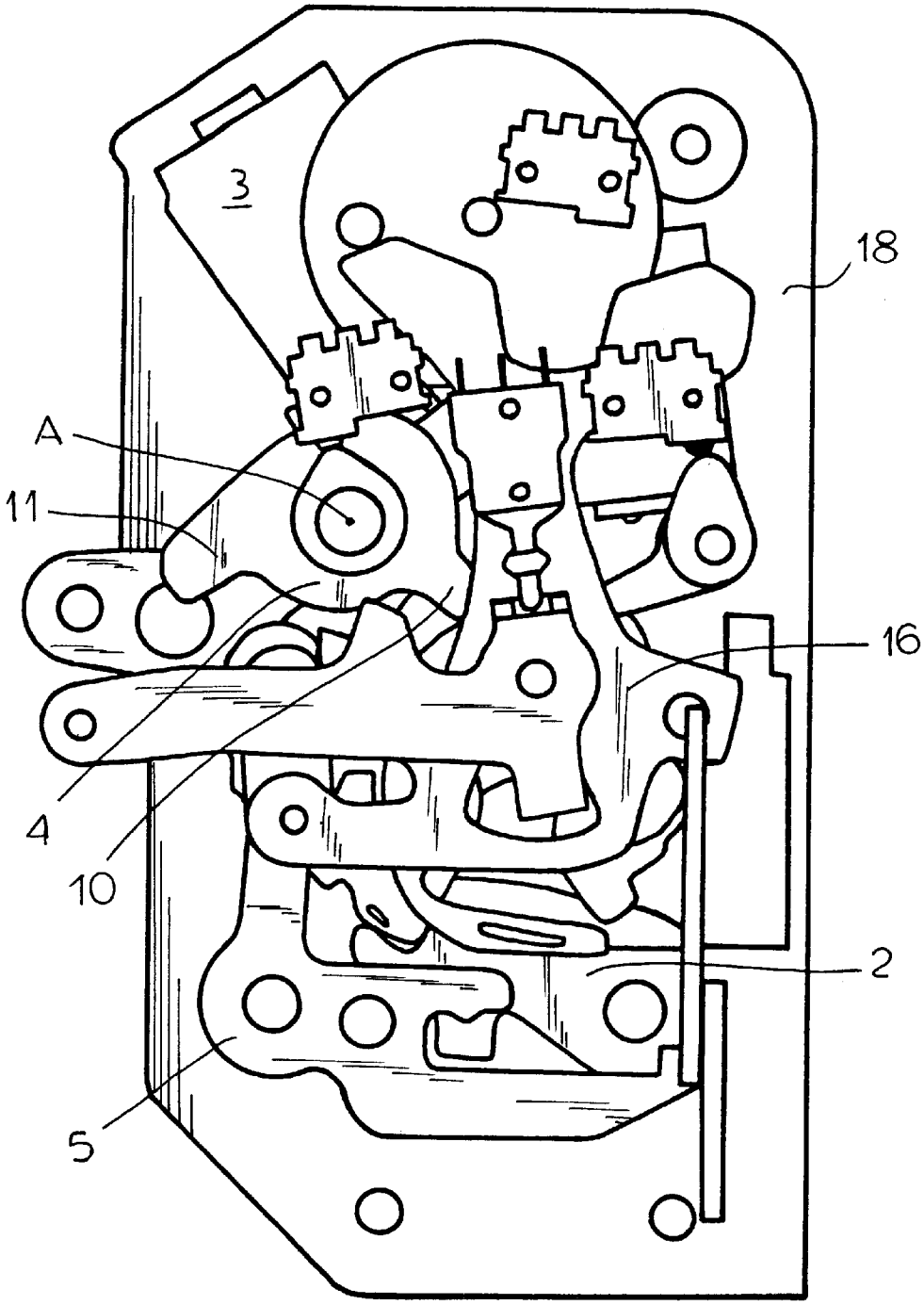
FIGS. 2*a* and 2*b* are side views of a variant on the FIG. 1 latch.
Figure 2B:
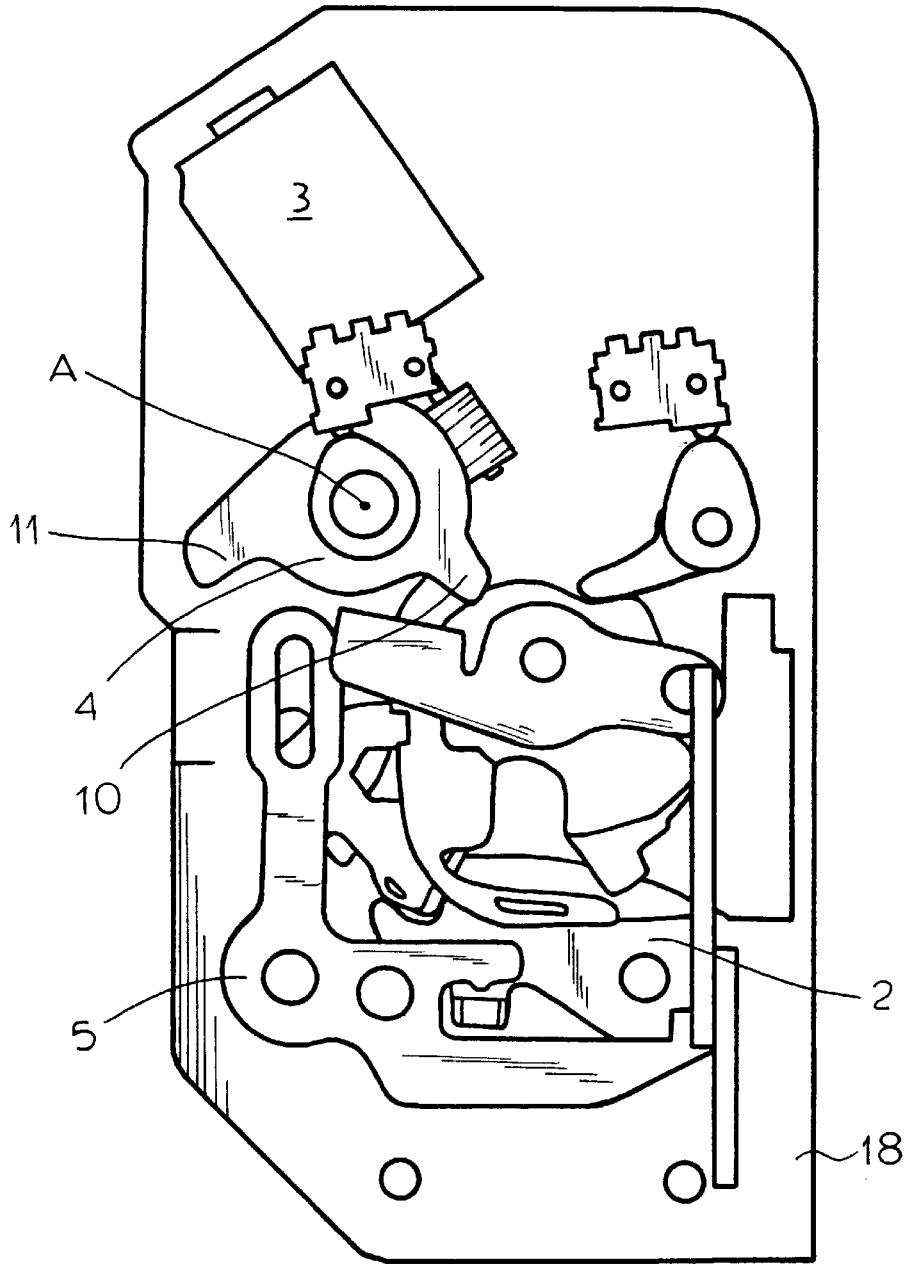

In the antitheft-on position of FIG. 2 the arm 10 of the member 4 has previously been moved clockwise by the drive 3 or by the cylinder 15 through the locked position (FIG. 5) into the illustrated antitheft-on position. The locking lever 16 thus bears with its abutment 9 on the arm 10 and is prevented from moving.

Figure 3:
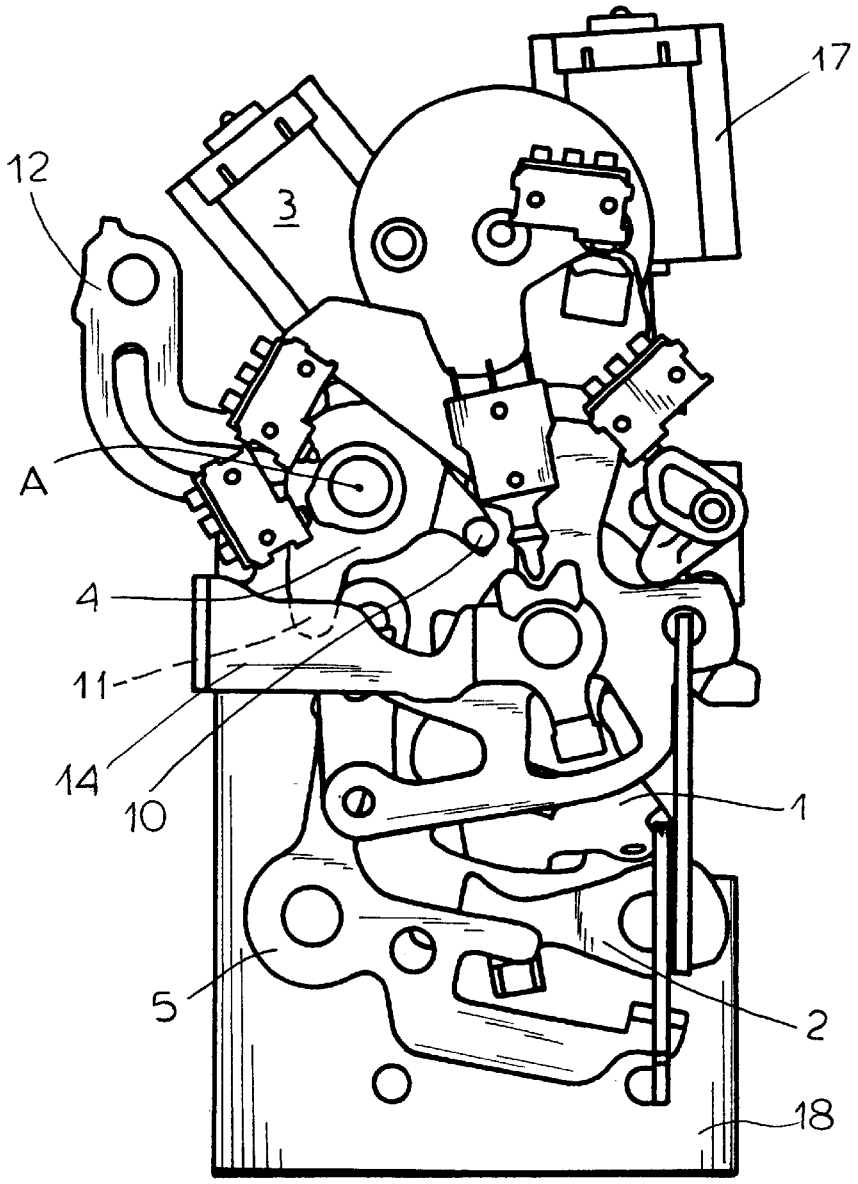
FIGS. 3, 4, and 5 are views of the latch of FIGS. 1 and 2 in various positions.
Figure 5:
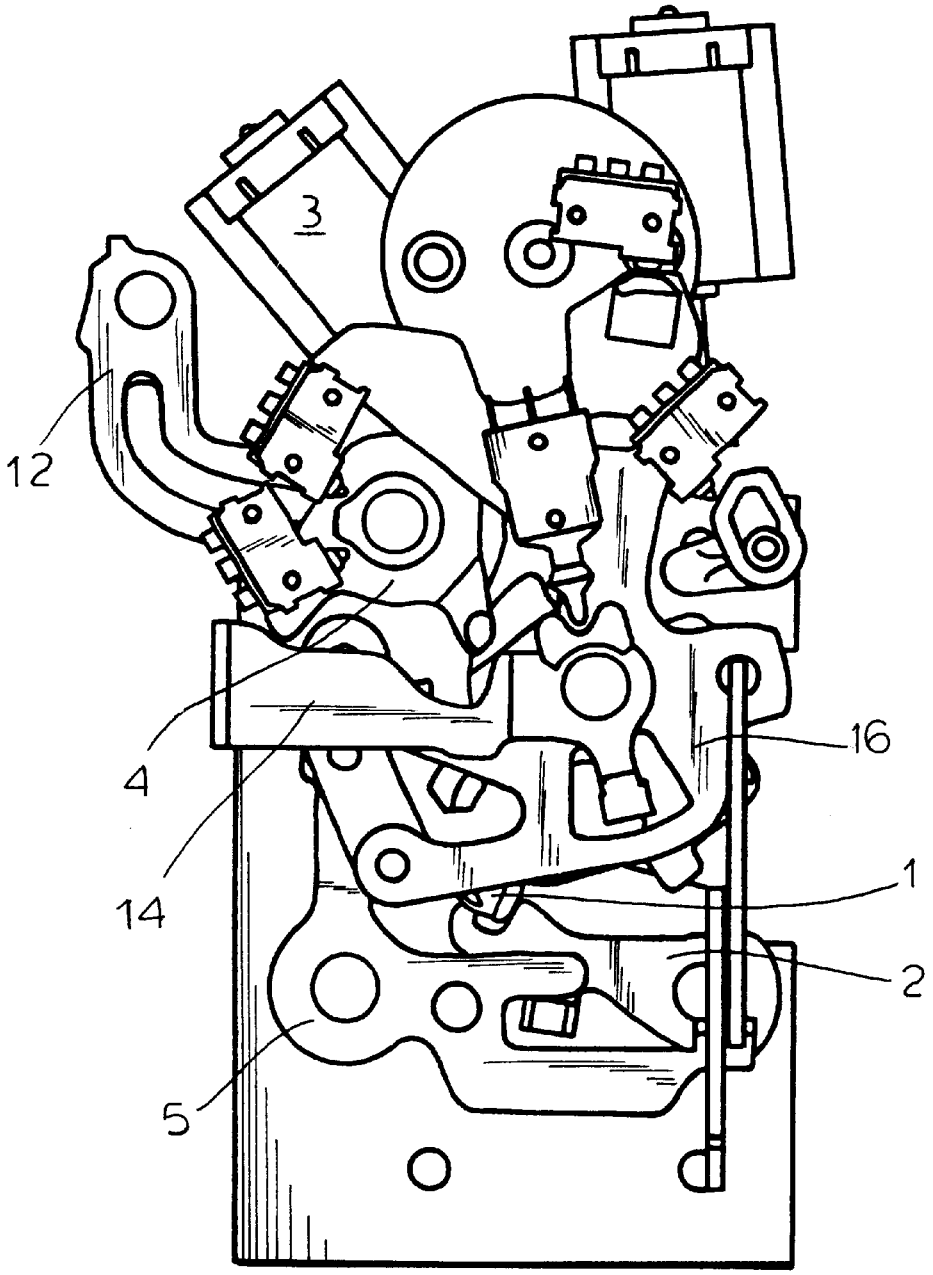

To go into the antitheft-off position the lever arm 10 is either moved by the cylinder 15 or drive 3 to rotate counterclockwise into the FIG. 5 null position in which it frees the locking lever 16. In this position if, for example, a micro-switch operated by an outside door handle is tripped the member 4 is rotated clockwise and the as shown in FIG. 3 its arm 11 pushes the release lever 5 (although it can act directly on the pawl 2) to open the latch. As also shown in FIG. 3 the antitheft feature is always off when electrical power opening is engaged since the member 4 stops in its null position.

Figure 4:
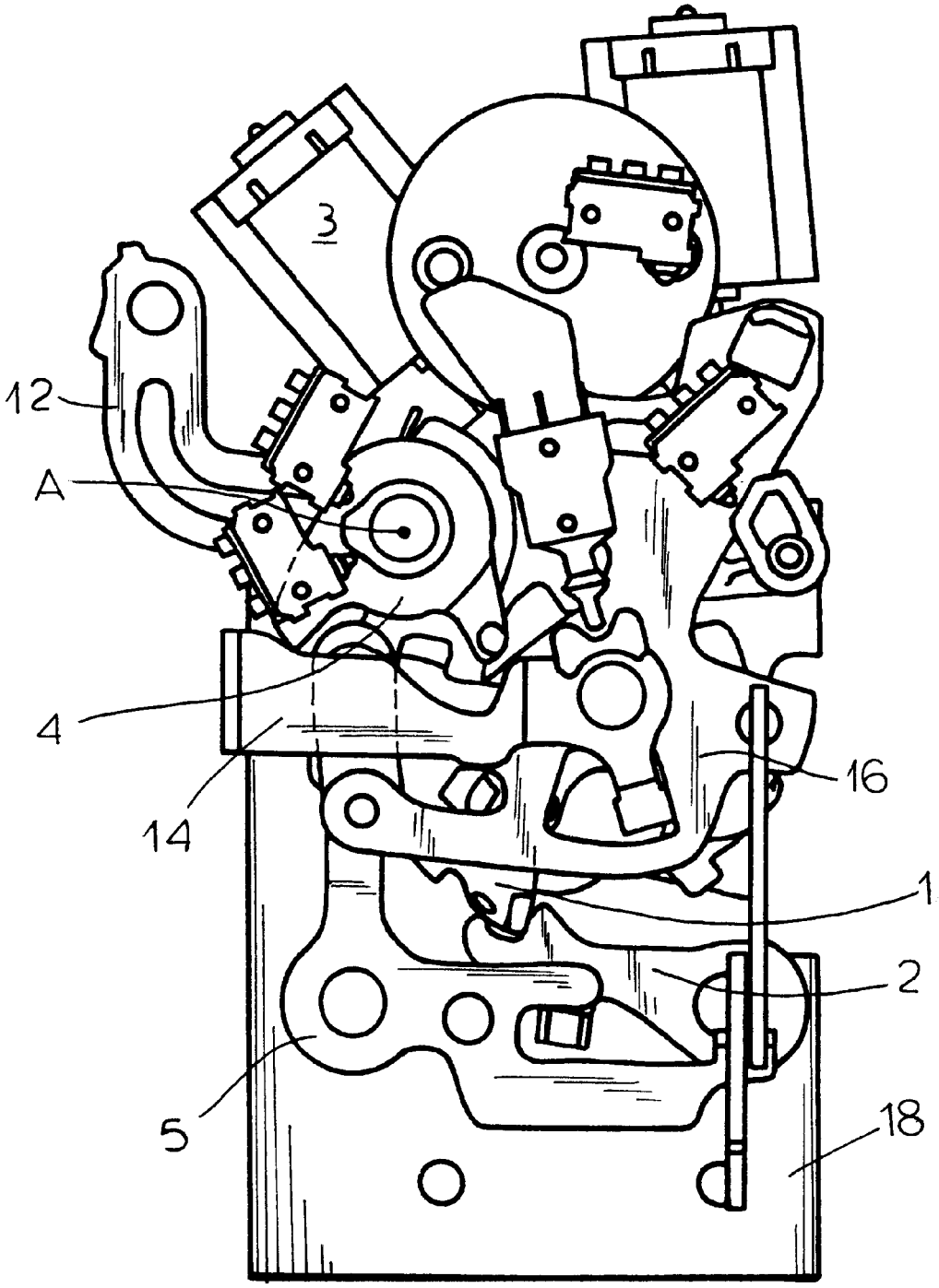

FIG. 3 further shows that the member 4 can also perform its various functions solely with the arm 10 when the member 4 is pivoted counterclockwise through about 180° into the FIG. 4 null position and then further through 360° into the FIG. 3 engaging the release lever 5. In a keyless entry system the above-described functions take place directly before unlatching and are effected by the central-locking drive 17 which passes right through the null position and goes directly from the position of FIG. 5 to that of FIG. 3.

Once the position of FIG. 3 has been reached and the latch has been opened, the parts are returned by the drives 3 and/or 17 and/or by an unillustrated spring in to the position of FIG. 4.

The system is switched from the antitheft-on to the antitheft-off position by remote actuation or the standard mechanical key. Actuation by a key in the cylinder 15, for example, rotates the member 4 counterclockwise into the null position. A switch prevents return of the member 4 from this position into the antitheft-on position.

In the event of power failure, the outside locking lever 14 is rotated by the cylinder 15 which in turn bears via the cam bump 7 on the member 4 to pivot it out of the antitheft-on position and unlock the latch. If the drive 3 for the anti theft and power-open function fails the spring loaded release lever 4 of the spring-loaded pawl 2 moves into the null position so the pawl 2 is not permanently blocked. Thus even if power fails, the latch according to the invention can be operated manually.

I claim:

1. A motor-vehicle door latch comprising:

a latch housing;

a latch fork pivotal on the housing;

a latch pawl movable on the housing between a holding position engaging the latch fork and preventing pivoting of same and a freeing position permitting pivoting of the latch fork;

a locking lever displaceable coupled with the latch pawl and displaceable between an unlocked position permitting the a latch pawl to move into the freeing position and a locked position preventing movement of the latch pawl into the freeing position;

a pivotal control member movable between a power-open position pivoting the latch pawl into the freeing position, an antitheft-on position blocking movement of the locking lever into the unlocked position, and an antitheft-off position permitting movement of the locking lever into the locked position; and drive means including a single electrical motor connected to the control member for pivoting same the control member between the power-open, antitheft-on, and antitheft-off positions.

2. The motor-vehicle door latch defined in claim 1, further comprising a release lever connected between the control member and the latch pawl.

3. The motor-vehicle door latch defined in claim 1 wherein the control member is pivotal and has an arm engageable directly with the locking lever and at least indirectly with the latch pawl.

4. The motor-vehicle door latch defined in claim 1 wherein the control member is pivotal and has one arm engageable directly with the locking lever and another arm at least indirectly engageable with the latch pawl.

5. The motor-vehicle door latch defined in claim 1, further comprising an outside actuating lever; and an outside locking lever displaceable between a position coupling the outside actuating lever with the latch pawl and a position decoupling the outside actuating lever from the latch pawl, the control member being pivotal and having a bump engageable with the outside locking lever to displace same into its decoupling position.

6. The motor-vehicle door latch defined in claim 5, further comprising an outside cylinder coupled to the outside locking lever to displace it between its coupling and decoupling positions, the member having a cam bump engageable with the outside locking lever for displacement of the member into the antitheft off position on actuation of the outside locking lever by the cylinder.

* * * * *